United States Patent [19]

Veillette et al.

[11] Patent Number: 4,578,690

[45] Date of Patent: Mar. 25, 1986

[54] CARBONLESS DEVELOPER SHEET

[75] Inventors: Norman T. Veillette, Hollis; Robert J. Malik, Hudson, both of N.H.

[73] Assignee: Nashua Corporation, Nashua, N.H.

[21] Appl. No.: 639,739

[22] Filed: Aug. 13, 1984

[51] Int. Cl.[4] ..... B41M 5/16; B41M 5/22

[52] U.S. Cl. ..... 346/212; 346/216; 346/217; 346/221; 346/224; 346/225; 427/150; 427/151

[58] Field of Search ..... 346/212, 216, 217, 225, 346/204, 220, 221, 224, 226; 427/150, 151, 152

[56] References Cited

U.S. PATENT DOCUMENTS

| | | | |
|---|---|---|---|
| 3,874,895 | 4/1975 | Hayashi et al. | 346/225 |
| 4,216,299 | 8/1980 | Kikuga et al. | 346/225 |
| 4,263,047 | 4/1981 | Miyamoto et al. | 346/225 |
| 4,400,492 | 8/1983 | Asano et al. | 346/225 |

*Primary Examiner*—Bruce H. Hess
*Attorney, Agent, or Firm*—Lahive & Cockfield

[57] ABSTRACT

Disclosed is a recording sheet comprising a support having a layer of color developer capable of reacting with oil-soluble, basic, chromogenic dyes to produce rapidly a mark of improved color intensity and improved fade resistance. In addition to the conventionally used constituents such as binders, whitening agents, and fillers, the coating comprises (a) a phenol-formaldehyde condensate oligomer mixture, (b) an aromatic carboxylic acid, and (c) an inorganic magnesium compound, preferably magnesium oxide or magnesium hydroxide. Best results are obtained when components a, b, and c are present at ratios of 50 parts oligomer, 1.0–2.5 parts acid, and 10–40 parts magnesium compound.

5 Claims, No Drawings of the dye nucleus. These structural differences produce dyes which vary in color, fade resistance, and other properties. Perhaps the most common specific example of a dye of the class useful in the invention is crystal violet lactone, which has a dimethylamino group substituted in the para position on each of the aryl rings. The dyes useful in the invention are all colorless or substantially colorless in their leuco form, when the lactone ring is closed, and become colored on opening of the lactone ring. The dyes may be used singly or in combination to achieve a selected color in accordance with techniques well known to those skilled in the art.

As is well understood in the art, the dyes may be dissolved in a suitable oily solvent such as amyl biphenyl and coated on a paper web as isolated, discrete, pressure-rupturable droplets. Such coatings may be made, for example, in accordance with the procedure disclosed in U.S. Pat. No. 2,800,457 to Greene et al. A specific example is set forth below. (Parts are all by weight unless otherwise indicated.)

Oil solution is prepared by dissolving 2% crystal violet lactone in a mixed oil comprising 4 parts alkyl substituted biphenyl and 1 part lamp oil. 40 parts of the oil solution is then added to an aqueous solution consisting of 10 parts acid-processed pigskin gelatin and 10 parts gum arabic dissolved in 400 parts 40° C water containing 0.2 parts Turkey red oil as an emulsifying agent. When the size of the oil droplets averages on the order of five microns, emulsification is discontinued. 40° C. water is added thereto to make a total of 900 parts and stirring is continued. The pH of the solution is then adjusted to about 4.0 by the addition of 10% aqueous acetic acid to induce coacervation. After stirring for an additional 20 minutes, the solution is cooled with ice water to cause gelation of the coacervate membrane deposited about the oil droplets. When the temperature of the solution reached 20° C., 7 parts of 37% formaldehyde is added. At 10° C., the pH of the solution is adjusted by the addition of a 15% aqueous sodium hydroxide solution.

Subsequently, the temperature of the solution is raised to 50° C. over a 20 minute period while stirring. After adjustment of the temperature, the microcapsule dispersion thus obtained is applied to a 40 gram/m$^2$ paper at a coating weight of 6 g/m$^2$ and dried.

In this way it is possible to obtain microcapsule coatings containing crystal violet lactone or any other color former of the triarylmethane lactone type, merely by altering the identity of the dye or dyes dissolved in the alkyl biphenyl.

The oil-soluble chromogenic dyes held within the CB sheet on release produce an intense color which resists fading if used in connection with developer coatings of the invention. This useful and enhanced effect is achieved by means of the interaction of a combination of certain relatively inexpensive materials included as essential ingredients in the developer coating mix. As indicated above, these essential components include certain substituted phenol-formaldehyde condensate oligomers having 2 to 10 phenolic units, substituted phenolic units, or the zinc modified analogs thereof, an aromatic (preferably monoaromatic) carboxylic acid having one or more carboxylic acid groups, and an inorganic magnesium compound, preferably magnesium hydroxide, magnesium oxide, or various mixtures thereof. Omission of any one of these components eliminates the advantages obtained by the practice of the invention. Furthermore, magnesium salts of aromatic carboxylic acids, if used in place of the separate aromatic carboxylic acid and the magnesium compound, do not succeed in achieving the unique properties of the composition of the invention, and accordingly are not equivalent.

Aside from these essential components, the developer coating composition may also contain binders, whitening pigments, surface area extenders, lubricants, as well as minor amounts of antifoaming agents, conventional dispersing aids, and protective colloids to aid in processing and for other purposes, all in accordance with conventional practices.

The coating composition of the invention may be prepared as two separate compositions which are added together and mixed thoroughly prior to coating. In this approach one produces a first homogeneous aqueous dispersion (resin emulsion) containing the oligomer resin preparation, the aromatic carboxylic acid, the antifoaming agents, and the protective colloids, and a second aqueous dispersion (pigment dispersion) comprising the pigments, surface area extenders, binders, and magnesium compound. After preparation, these two compositions are mixed together with smaller quantities of antifoaming agents, lubricants, and phosphates for viscosity control.

Resins useful in the process of the invention are available commercially from, for example, Schenectady Chemical Co., Occidental Chemical Company, Georgia Pacific Company, or Mitsui Toatsu. Before use, the resins as purchased are reduced in particle size by means of emulsification, comminution, or other wet or dry grinding processes to make a uniform homogeneous aqueous dispersion of resin having a particle size on the order of 1–10 microns. To stabilize and insure homogeneity of the resin emulsion, one adds antifoam agents, conventional, commercially available anionic or nonionic dispersing agents such as Tweens, Tamols or Tritons, and protective colloids such as hydroxymethylcellulose, carboxymethylcellulose, or polyvinyl alcohol. Preferably, the aromatic carboxylic acid is also dispersed in the resin mix.

The aqueous pigment mix composition typically includes, in addition to pigments, surface area extenders or fillers, binders, and the magnesium compound. The preferred whitening and extending pigments are inert to the acid colorable dyes, but active materials may be used. Suitable inactive whitening and extending pigments include sodium aluminum silicates such as those sold under the tradenames Hysil and Hydrex, titanium dioxide, calcium carbonate, magnesium-calcium carbonate minerals such as dolomite, hydrated aluminas such as the material sold under the tradename Paperad, inert kaolin coating clays, and other clays. Examples of active whitening pigments include acid clays, activated clays, and surface treated sodium aluminum silicates. Conventional lubricants such as metal stearates and amine waxes may also be included. Such materials as starches, modified starches, and latices such as styrene-butadiene, rubber, acrylics, or acetates are useful as binders.

It is preferred to pre-disperse the magnesium compound, e.g., in a high shear dispersing mill in water at approximately 40% solids, before introducing the magnesium compound into the pigmenting composition.

The resin mix and pigment mix are combined prior to coating, together with additional small amounts of antifoam agents and lubricants if necessary, and with phosphates for viscosity control. Percent solids of the result-

CARBONLESS DEVELOPER SHEET

BACKGROUND OF THE INVENTION

This invention relates to a recording sheet and more particularly to an improved color developer sheet which reacts with certain nearly colorless dyes to form an intensely colored image.

Recording sheets comprising isolated discrete droplets of an oil solution containing a substantially colorless dye and a separate composition which reacts with the dye to develop color are well known. An example is commonly referred to as carbonless copy paper. Such products comprise two or more sheets, one or more having a coated back (CB) containing a plurality of isolated discrete droplets of oil containing one or more dissolved dyes, and one or more sheets having a coated front (CF) containing a layer of color developer mixed with a binder. When the sheets are placed in face to face contact, marking pressure on the top sheet releases the dye in the CB which is developed on contact with the developer in the CF. Such developer compositions generally employ as an active ingredient a phenolic resin material, a clay or clay-like material such as montmorillonite clay, acid clay, activated clay, zeolite, or bentonite, or an organic acid. Some improvement in color intensity in phenolic resin-based developer materials may be obtained by neutralizing certain of the phenolic hydroxyl groups with metal ions such as zinc ions. The prior art literature also reports that metal salts of certain aromatic carboxylic acids may be used to improve color intensity in CF compositions.

SUMMARY OF THE INVENTION

From the very large number of combinations of dyes and developer materials available for use in such carbonless systems, a specific formulation has now been developed which results in the rapid production of deeply colored marks which resist fade on exposure to the environment.

The invention is embodied as a coating composition for use in developing oil-soluble, basic, acid-colorable, substantially colorless triarylmethane lactone dyes. The dyes are characterized by the general structural formula:

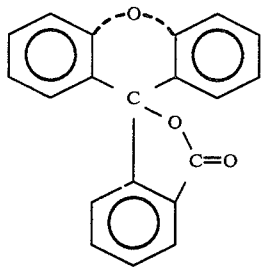

Various alkyl, phenyl, analino, amino, halogen, and other moieties may be substituted at one or various combinations of locations on each of the phenyl groups to alter the developed color of the dyes. The ether linkage shown in dashed lines is an optional structural component of the dyes. When the ether linkage is present the dye is known as a fluoran dye. As used here, the phrase triaryl methane lactone dye includes dyes having a structure of the type set forth above including fluoran dyes. It is believed that the colored form of the dyes is produced as the lactone ring opens on exposure to an acidic environment.

In accordance with the invention there are three critical components which act in combination with each other and with dyes of the type set forth above to result in fast development of marks of improved intensity and fade resistance.

The first component is a phenol-formaldehyde condensate oligomer mixture consisting of one or a mixture of the following components:

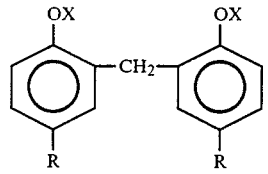

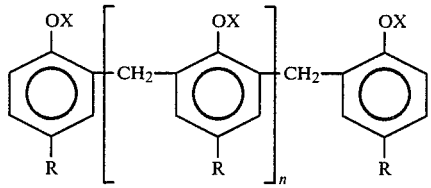

where X is independently hydrogen or zinc, R is independently an alkyl group having one to eight carbon atoms, a phenyl group, or a hydrogen atom, and n equals 1–8. When at least some of the X moieties are zinc ions, the oligomer mixture is said to be zincated or zinc-modified. The second component in the coating composition is an aromatic carboxylic acid, preferably benzoic acid or salicylic acid. The third critical component in the coating composition is an inorganic magnesium compound, preferably magnesium hydroxide or magnesium oxide.

Good results are obtained when a mixture of basic chromogenic, acid colorable dyes are used in the CB, and the ratio of the three required components in the CF composition is 50 parts phenolic resin material, 0.5–4 parts, preferably 1–2.5 parts, aromatic carboxylic acid, and 4–50 parts, preferably 10–40 parts, magnesium compound. Best results are achieved when, for each 50 parts of oligomer material, 1.25 to 1.5 parts aromatic carboxylic acid and 18–30 parts magnesium compound are present in the coating mix.

It is an object of the invention to produce carbonless copy paper characterized by improved, dark-colored images which resist light-induced fading. Another object is to provide improved coated front compositions receptive to conventional inks to facilitate the printing of forms and the like. Still another object is to provide coating compositions for carbonless copy paper made of relatively inexpensive materials. Another object is to provide a coated front composition capable of rapidly developing colored images.

DESCRIPTION

Although other dyes may be used, the dyes preferred in the carbonless copy paper of the invention are generally known as triarylmethane lactone dyes. A great variety of leuco dyes of this class are available from European, U.S., and Japanese manufacturers and distributors. The dyes differ generally with respect to the combination of radicals substituted on the aryl groups ing coating mix can vary widely, depending on the coating weight desired and the type of coating equipment employed. Good results are achieved at a coating weight of about 2–4 pounds per ream ($\cong 3\frac{1}{4}-6\frac{1}{2}$ g/m$^2$).

While the selection and quantities of antifoaming agents, dispersing agents, protective colloids, active or inert whitening and extending pigments, binders, and lubricants may be varied widely, in order to achieve the outstanding image intensity, fade resistant and rapid development properties of marks in accordance with the invention, it is required that an aromatic carboxylic acid, a magnesium compound, and an oligomer resin mixture of the types set forth above be included in the composition. It has also been discovered that the three components should be present in certain weight ratios. Specifically, the aromatic carboxylic acid should be present at 0.5–4 parts, the magnesium compound at 4–50 parts, and the phenol formaldehyde oligomer at 50 parts. When ratios outside the foregoing are employed, the advantages of the invention are rapidly lost. Best results within the foregoing range are achieved where, for every 50 parts of resin used, the acid is present at 1–2.5 parts, preferably 1.25–1.5 parts, and the magnesium compound at 10–40 parts, preferably 18–30 parts. One highly preferred composition comprises 50 parts of an oligomer mixture of non-zincated or zinc-modified phenol formaldehyde condensate comprising 2–10 phenolic units, a portion of which are substituted in a para position with a tertiary butyl group, 30 parts magnesium hydroxide, and 1.5 parts benzoic acid. These three required ingredients typically constitute between 15% and 40%, preferably 20–35%, and most preferably about 30% of the total weight (excluding water) of the coating composition. Generally, the speed of development of the mark increases with increased aromatic carboxylic acid content, and fade resistance is improved with increased magnesium compound.

To demonstrate the advantages achieved using coating compositions made in accordance with the invention, experimental compositions were prepared which were similar in all material respects except that the nature and quantity of the critical components of the composition were altered or one of the components was omitted. These experimental compositions were prepared in accordance with the procedure which follows, thereafter coated on paper at a coating weight of approximately 3 pounds/ream (3000 ft$^2$ ream), and dried. They were tested using two different CB sheets which differed with respect to the combination of triarylmethane lactone dyes contained in the pressure-rupturable droplets: one CB containing a mixture of dyes which result in a blue mark, and one which produces a black mark. In each case, the coating composition was prepared by procedures such as the following.

To about 104 parts deionized water were added about 106 parts (72 parts dry weight) coating clay slurry, 20 parts mineral whitener such as calcium carbonate (15 parts dry weight) and varying quantities of predispersed magnesium compound.

Separately, 96 parts binder comprising a mixture of a dispersion of a natural gum and a styrene butadiene latex (16 parts dry weight) were mixed with 4 parts zinc stearate lubricant (2 parts dry weight) and varying quantities of phenol-formaldehyde oligomer, either unmodified or zincated, comprising a mixture of oligomers having 2–10 repeating units comprising phenol groups or tertiary butyl phenol groups. The oligomer was prepared as an emulsion (30–50% solids) which had been mixed, in some cases, with an aromatic carboxylic acid.

The two compositions were added together and then stirred at low speed for 3 minutes to one hour. Viscosity was reduced, where appropriate, by the addition of hexameta phosphate.

The various ratios of aromatic carboxylic acid, generally benzoic acid, the oligomer blend, and the magnesium compound, and the color intensity of marks produced with the coating compositions using the two CBs disclosed above are set forth in the following table.

| Composition Number | Aromatic Acid(a) | Oligomer Blend(a) | Magnesium Compound(a) | Intensity with (b): Blue CB | Black CB |
|---|---|---|---|---|---|
| 1 | 0 | 17.3(c) | 0 | — | 50.8 |
| 2 | 0.48(k) | 17.5(c) | 0 | — | 51.0 |
| 3 | 0 | 18.8(c) | 19.1(e) | 46.1 | 57.0 |
| 4 | 0 | 19.4(c) | 9.8(e) | 46.1 | 52.3 |
| 5 | 0.36(j) | 17.3(c) | 19.1(e) | 46.9 | 56.0 |
| 6 | 0.38(j) | 17.9(c) | 3.65(f) | 37.8 | 46.9 |
| 7 | 0.38(j) | 17.9(g) | 3.65(f) | 32.0 | 41.0 |
| 8 | 0.38(j) | 18.1(i) | 3.64(f) | 36.3 | 46.9 |
| 9 | 0.33(j) | 15.7(c) | 2.5(h) | — | 46.3 |
| 10 | 0.33(j) | 15.5(g) | 4.2(h) | — | 43.9 |
| 11 | 0.33(j) | 15.5(g) | 4.2(f) | — | 43.9 |
| 12 | 0.40(j) | 19.3(g) | 4.2(f) | — | 43.3 |
| 13 | 0.36(j) | 17.1(g) | 3.4(f) | — | 42.0 |
| 14 | 0.38(j) | 18.1(c) | 3.6(f) | — | 45.5 |
| 15 | 0.35(j) | 16.8(g) | 3.4(f) | — | 42.4 |
| 16 | 0.35(j) | 16.8(g) | 3.4(f) | — | 40.9 |
| 17 | 0.38(j) | 17.9(c) | 3.65(f) | 34.8 | 45.5 |
| 18 | 0.38(j) | 17.9(i) | 3.65(f) | 36.3 | 46.9 |
| 19 | 0.38(j) | 17.8(g) | 7.3(f) | 30.3 | 42.4 |
| 20 | 0.56(j) | 17.8(c) | 7.3(f) | 33.4 | 44.7 |
| 21 | 0.56(j) | 17.8(g) | 10.9(h) | 29.8 | 37.3 |
| 22 | 0.55(j) | 17.3(g) | 7.1(h) | 31.8 | 39.4 |
| 23 | 0.38(k) | 17.9(c) | 3.65(f) | 40.3 | 49.2 |
| 24(m) | 0.56(j) | 17.8(c) | 10.9(f) | 34.8 | 46.9 |
| 25 | 0.57(j) | 18.0(e) | 10.9(f) | 34.3 | 46.2 |

(a)Expressed as percent of composition by weight, excluding water.
(b)Color intensity was measured with a reflectometer. Lower numbers indicate darker, more intense mark.
(c)Unmodified
(e)Magnesium benzoate
(f)Magnesium hydroxide
(g)Zn modified
(h)Magnesium oxide
(i)50:50 blend of modified and unmodified resin
(j)Benzoic acid
(k)Salicylic acid
(m)Most preferred composition As can be appreciated by comparing examples 1–25 set forth above, when the aromatic carboxylic acid is omitted (Ex 1, 3 and 4), when the magnesium compound is omitted (Ex 1 and 2), or where the magnesium salt of an aromatic carboxylic acid is used in place of the separately added inorganic magnesium compound and organic acid (Ex 3, 4 and 5), the color intensity on the Blue CB lies in the mid 40 range and on the Black CB in the low to mid 50 range. In contrast, in compositions embodying the invention (Ex 6 through 25) the color intensity is consistently in the range of 30–40 on the Blue CB and is in the low 30 range for preferred compositions. With respect to Black CB, the color intensity is generally in the low to mid 40 range and is in the high 30 to low 40 range for preferred compositions.

Because the prior art teaches that salts of aromatic carboxylic acids may be useful as developers for leuco dyes, experiments were conducted to determine whether a reaction was occuring during formulation between the magnesium compound of the type used in the invention and the aromatic carboxylic acid. Equal portions (200 mg) of benzoic acid and magnesium hydroxide were added to 10 grams of deinonized water, agitated for two minutes, and then filtered through a 0.45 micron filter. The filtrate was then analyzed by an atomic absorption to determine soluble metal and analyzed by infrared specroscopy to identify the material present. It was determined that of the 20,000 ppm benzoic acid and magnesium hydroxide originally present, only 665 ppm magnesium were present as benzoate. Thus, less than about 3.4% of the magnesium was present as the benzoate.

The invention may be embodied in other specific forms.

What is claimed is:

1. A sheet of record material sensitized with a CF coating to produce a color on contact with oil-soluble, basic chromogenic, acid colorable dyes, said coating characterized in that it includes:

A. a phenolic resin material consisting of one or a mixture of

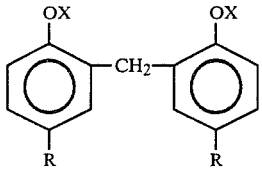

-continued

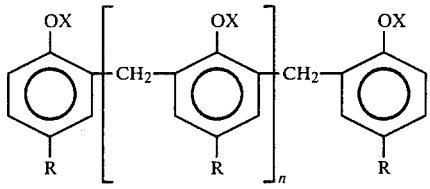

where X is independently hydrogen or zinc, R is independently an alkyl group having 1–8 carbon atoms, an aryl group, or a hydrogen atom, and n equals 1–8;

B. Benzoic acid; and

C. an inorganic magnesium compound which is Mg(OH) 2, MgO, or a mixture thereof, wherein components A, B, and C are present in about the following ratio in parts by weight:

A. 50
B. 0.5–4.0
C. 4–40.

2. The invention of claim 1 wherein X is exclusively hydrogen.

3. The invention of claim 1 wherein X includes both hydrogen and zinc.

4. The invention of claims 1 wherein components A, B, and C are present in about the following ratio in parts by weight:

A. 50
B. 1.0–2.5
C. 10–40.

5. The invention of claim 1 further comprising a second sheet superposed in face-to-face relation to said sheet, said second sheet having a CB coating on the surface facing said CF coating, said CB coating comprising isolated, pressure rupturable, discrete droplets of an oil solution of at least one basic chromogenic, acid colorable, triarylmethane lactone dye.

* * * * *